United States Patent [19]

Pasty et al.

[11] Patent Number: 4,771,269

[45] Date of Patent: Sep. 13, 1988

[54] SYSTEM FOR DETECTING THE INCOMPLETE CLOSURE OF THE DOORS OF A CHAMBER HAVING AT LEAST TWO SUPERPOSED DOORS

[75] Inventors: Alain Pasty, Chevilly Larue; Jacques Vaillant, Bagneux, both of France

[73] Assignee: Jouan, Saint Nazaire Zone Industrielle de Brais, France

[21] Appl. No.: 38,225

[22] Filed: Apr. 14, 1987

[51] Int. Cl.[4] ..... G08B 13/08; H01H 3/16

[52] U.S. Cl. ..... 340/545; 49/67; 200/61.69; 340/547

[58] Field of Search ..... 340/545, 547, 549, 556; 200/61.62, 61.64, 61.69; 49/13-14, 67

[56] References Cited

U.S. PATENT DOCUMENTS

| | | | |
|---|---|---|---|
| 4,227,766 | 10/1980 | Finale | 340/545 X |
| 4,241,337 | 12/1980 | Prada | 340/547 |
| 4,278,968 | 7/1981 | Arnett et al. | 340/545 |
| 4,292,629 | 9/1981 | Kerr et al. | 200/61.69 X |
| 4,302,907 | 12/1981 | Canals et al. | 49/67 X |
| 4,583,082 | 4/1986 | Naylor | 340/545 |

*Primary Examiner*—Glen R. Swann, III
*Assistant Examiner*—Thomas J. Mullen, Jr.
*Attorney, Agent, or Firm*—Scully, Scott, Murphy & Presser

[57] ABSTRACT

The invention relates to a system for detecting the incomplete closure of the doors of a chamber with at least two doors (14, 16), one an inner door and the other an outer door, arranged one behind the other in front of an orifice of the said chamber and mounted pivotally between an open position and a closed position about two parallel pivot axes (18, 24) respectively.

The detection system comprises an active element (34) capable of causing an action in a particular direction and a sensor element (36) sensitive to the said action, the said elements being fastened one to the inner door (14) and the other to the outer door (16) at a point located opposite the other element, in such a way that the sensor element is in the line of action of the active element only when the two doors are closed correctly.

5 Claims, 1 Drawing Sheet

Figure 1:
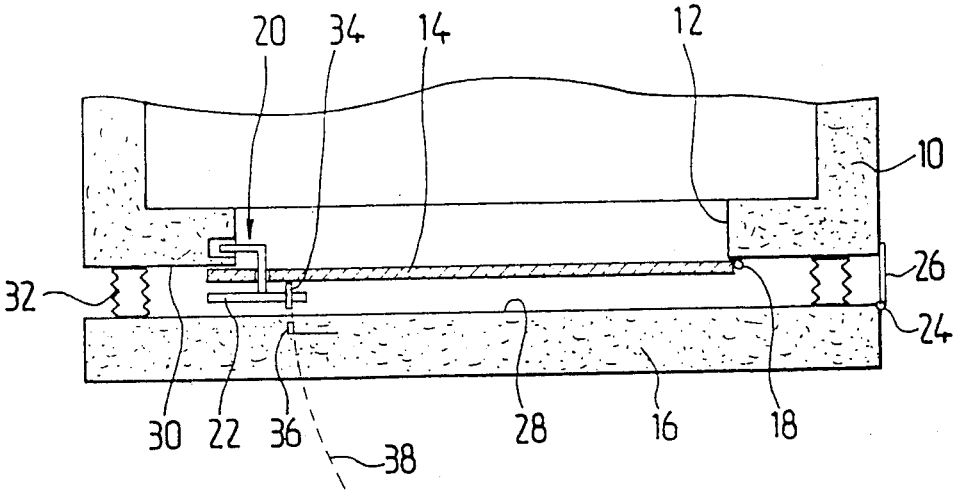

SYSTEM FOR DETECTING THE INCOMPLETE CLOSURE OF THE DOORS OF A CHAMBER HAVING AT LEAST TWO SUPERPOSED DOORS

Some chambers are equipped with superposed doors. This is true, for example, of some high-security safes or of carbon-dioxide cell-culture incubators.

For the sake of clarity, this specification will only refer to the use for cell-culture incubators, but it goes without saying that the teachings of the application apply to any type of chamber equipped with two superposed doors which have to be hermetically sealed.

As is known, cell-culture incubators must be insulated from the outside as perfectly as possible, so that the carbon dioxide content of its atmosphere, its temperature and its relative humidity vary as little as possible. Moreover, these parameters are controlled continuously in a measuring device which returns them to their normal value when a significant deviation from this has been detected. The provision of two doors makes it possible to achieve a higher quality in the control of these parameters.

In incubators, the inner door is usually transparent, to make it possible to observe the cell cultures directly. The outer door is heat-insulated, for example by means of a glass-wool slab enclosed between two metal walls, and it is equipped, all round its inner edge, with a flexible gasket, preferably of the concertina type, intended for absorbing the surface unevenness of the frame surrounding the access orifice of the incubator.

The inner door is articulated by means of a first series of hinges fastened in the vicinity of one vertical edge of the said frame, and it is equipped, on an opposite vertical edge, with a latch actuable by means of a handle or door knob. The outer door is itself articulated by means of a second series of hinges fastened to the frame along a vertical line offset laterally outwards relative to the first series of hinges and forwards relative to the plane of the frame by a distance slightly greater than the thickness of the gasket or by that of the handle of the latch. The outer door is usually retained in the closed position by means of a magnetized element accommodated inside the gasket.

Several devices for detecting incomplete closure have already been proposed in the past, in order to detect a fault in the closure of one of the two doors. For example, that described in U.S. Pat. No. 4,241,337 is known, but this relates instead to freezing or refrigerating cabinets which are equipped with two doors placed next to one another in the same plane and which do not have a latch.

The present invention provides a simple, accurate and economical system making it possible to detect and signal all the closing faults which may occur in a chamber of the above-mentioned type with two superposed doors, that is to say the incomplete closure of one of the doors or of both doors at the same time.

For this purpose, the detection system according to the invention is characterized in that it comprises an active element capable of causing an action in a particular direction and a sensor element sensitive to the action, the elements being fastened one to the inner door and the other to the outer door at a point located opposite the other element, in such a way that, when the two doors are closed correctly, the sensor element is in the line of action of the active element, and, when at least one of the doors is closed incorrectly, the elements are out of alignment because of the offset of the paths followed by the active element and by the sensor element, the sensor element being capable of then generating a signal which actuates an acoustic or luminous alarm device.

According to one embodiment of the invention, the active element is advantageously fastened to the latch of the inner door. In this way, even if the inner door is in the closing position, but the latch is incorrectly engaged, the active element and the sensor element will be out of alignment and the alarm system will be actuated.

In a particular embodiment of the invention, the active element is formed by a magnet fastened, for example, to the handle of the latch, and the sensor element is formed by a Hall-effect relay fastened to the outer door opposite the said magnet.

Figure 2:
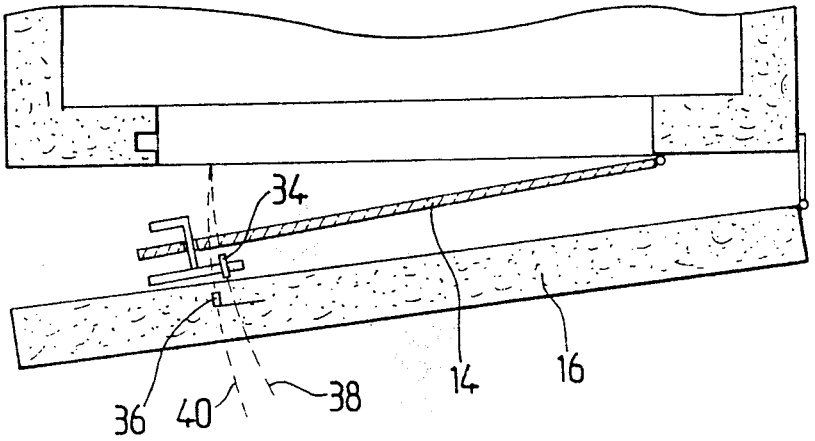

The advantages and characteristics of the invention will emerge more clearly from the following description of a particular embodiment, with reference to the accompanying drawing in which:

FIG. 1 is a partial sectional view of an incubator with its doors closed, which is equipped with a detection system according to the invention; and FIG. 2 is a partial diagrammatic view of the incubator when the two doors are incorrectly closed.

With reference to FIG. 1, the incubator comprises a heat-insulated box 10 equipped on its front wall with an access orifice 12 closed by means of a transparent inner door 14, through which the interior of the incubator can be observed, and by means of a heatinsulated outer door 16 which, in the closed position, covers the inner door.

The inner door 14 is mounted pivotally according to a pivot axis 18 placed along one edge of the orifice, and it is equipped with a latch 20 actuated by means of an operating handle 22.

The outer door 16 is itself mounted pivotally according to a pivot axis 24 parallel to the axis 18 and located at the ends of fittings 26 fastened to the side wall of the box. These fittings have a width sufficient to ensure that, when the outer door is closed, its inner wall 28 is parallel to the inner door 14 and is placed at a distance from the latter at least equal to the extra thickness formed by the inner door and the handle 22 of the latch in relation to the front face 30 of the box. In a way known per se, the outer door 16 is equipped, over the entire length of the periphery of its inner wall 28, with a flexible and extendable gasket 32, for example of the concertina type, which ensures, on the one hand, that the outer door is sealed shut and, on the other hand, that the two doors are parallel when they are in the closed position. Magnets preferably accommodated inside the gasket keep the outer door in the closed position.

According to the invention, to detect any fault in the closure of one of the two doors, a magnet 34, the pole line of which is preferably perpendicular to the plane of the inner door 14, is fastened to the operating handle 22 at a point offset relative to its axis of rotation. Fastened in the outer door 16 is a sensor 36 capable of detecting the magnetic field of the magnet when it is exactly opposite the magnet. The sensor is connected to an alarm system (not shown) by means of a conductor 38.

The sensor can be formed by a Hall-effect relay, but it is clear that the scope of the invention is not exceeded if an active element and an element sensitive to the action caused at a distance by the said active element are used instead of the magnet and the Hall-effect relay respectively. Thus, a source emitting luminous, infrared or ultrasonic radiation and a cell sensitive to the said radiation can be used.

Thus, when the inner door 14 is correctly latched and the outer door 16 is closed properly, the sensor 36 is exactly in line with the magnet 34: the alarm system is then inoperative.

Apart from this normal state, four abnormal situations can arise:

1. The two doors are closed, but the latch 20 is not engaged in the catch of the incubator because the handle 22 has been rotated. In this case, the magnet 34 is out of alignment with the sensor 36: the alarm system then becomes operative.

2. The outer door 16 is closed properly, but the inner door 14 is slightly out of its closing position. The magnet describes an arc of a circle 38 and comes out of alignment with the sensor. Here again, the alarm system is triggered. It goes without saying that, because of the very slight misalignment occurring in this case, the signal received by the sensor must be amplified. As soon as it falls below a predetermined value, it triggers the alarm.

3. The inner door is latched correctly, but the outer door is slightly open. This results in a slight misalignment between the magnet and the sensor which, as before, causes the alarm to be actuated.

4. The two doors are slightly open. This is illustrated in FIG. 2. Because the magnet 14 and the sensor 36 describe arcs of a circle 38, 40 of different and offset radii, they are out of alignment even when the opening angle of the doors is only very small.

We claim:

1. A system for detecting the incomplete closure of the doors of a chamber with at least two superposed doors, one an inner door (14) and the other an outer door (16), arranged one behind the other in front of an orifice of the said chamber and mounted pivotally between an open position and a closed position about two parallel pivot axes (18, 24) respectively, the pivot axis (24) of the outer door being offset laterally outwards relative to that of the inner door and being raised offset relative to the plane of the inner door, the detection system being characterized in that it comprises an active element (34) capable of generating a detectable signal in a particular direction and a sensor element (36) sensitive to said detectable signal, the said elements being fastened one to the inner door (14) and the other to the outer door (16) such that each element is located opposite the other, in such a way that, when the two doors are closed correctly, the sensor element is in the line of detection of the active element, and, when at least one of the doors is closed incorrectly, the said elements are out of alignment because of the lateral and raised offsets of the two parallel pivot axes, whereby the sensor element is out of the line of detection of the active element, the said sensor element being capable of then generating a signal which actuates an acoustic or luminous alarm device.

2. A detection system according to claim 1, where the inner door (14) is equipped, near the edge opposite the pivot axis (18) of the said door, with a latch (20) actuable by means of a pivoting handle (22), characterized in that the active element (34) is fastened to the said handle at a point offset relative to the pivot axis of the handle.

3. A detection system according to claim 1, where the inner door is equipped with a latch actuable by means of a sliding handle, characterized in that the active element is fastened at any point on the handle.

4. A detection system according to one of claims 1 to 3, characterized in that the said active element is formed by a magnet (34), and in that the sensor element is formed by a magnetic field detection sensor, for example a Hall-effect relay.

5. A detection system according to one of claims 1 to 3, characterized in that the active element and the sensor element are formed respectively by a source of luminous, infrared or ultrasonic radiation and by a cell sensitive to the said radiation.

* * * * *